US007234887B2

(12) United States Patent
Chiang

(10) Patent No.: US 7,234,887 B2
(45) Date of Patent: Jun. 26, 2007

(54) COUPLING DEVICE FOR AN ARTIFICIAL MODEL

(76) Inventor: Jung-Chang Chiang, 4F-1, No. 100, Tien-Yu Street, Taipei (TW) 111

( * ) Notice: Subject to any disclaimer, the term of this patent is extended or adjusted under 35 U.S.C. 154(b) by 0 days.

(21) Appl. No.: 10/714,385

(22) Filed: Nov. 13, 2003

(65) Prior Publication Data

US 2005/0105965 A1 May 19, 2005

(51) Int. Cl.
*A47F 8/00* (2006.01)
*F16C 11/04* (2006.01)

(52) U.S. Cl. ..... 403/13; 403/14; 403/59; 403/322.2; 403/348; 403/408.1; 403/409.1; 446/376

(58) Field of Classification Search ..... 403/13, 403/14, 52, 59, 78, 322.2, 348, 349, 408.1, 403/409.1; 446/376
See application file for complete search history.

(56) References Cited

U.S. PATENT DOCUMENTS 4,954,005 A * 9/1990 Knasel et al. ..... 403/57
6,485,215 B1 * 11/2002 Chiang ..... 403/78
6,619,875 B2 * 9/2003 Chiang ..... 403/322.2

FOREIGN PATENT DOCUMENTS

| | | | |
|---|---|---|---|
| DE | 20300438 U1 | * | 8/2003 |
| JP | 8-294435 | * | 11/1996 |
| JP | 2004-49448 | * | 2/2004 |
| JP | 2005021234 A | * | 1/2005 |
| KR | 2003003185 A | * | 1/2003 |

* cited by examiner

*Primary Examiner*—Daniel P. Stodola
*Assistant Examiner*—Ernesto Garcia

(57) ABSTRACT

A coupling device for an artificial model includes a male joining part, a female joining part and an insertion member. The male and female joining parts have a base disk attached with a front positioning plate and a rear lock plate respectively. The insertion member further includes an insert head, an adjustable bolt, a first elastic body, a cap, a pin, a ball, a second elastic body and a setscrew. The insertion member is inserted into the male and female joining parts such that the male joining part can open any angles with respect to the female joining part smoothly.

13 Claims, 13 Drawing Sheets

COUPLING DEVICE FOR AN ARTIFICIAL MODEL

BACKGROUND OF THE INVENTION

1. Field of the Invention

The present invention relates to a coupling device for an artificial model, and, particularly, to a coupling device, which has a male connecting member and a female connecting member being attached to two opposite connecting surfaces of the neck and the hip of the artificial model respectively to allow the two connecting surfaces being joined to each other tightly with two sets of elastic bodies.

2. Description of Related Art

The conventional artificial model 30 shown in FIG. 10 provides a hip part with a connecting surface 31 and a thigh part with another connecting surface 32. Further, a joining device 33 is provided for joining the connecting surfaces 31, 32. Usually, the joining device 33 has a locating stem extending outward from one of the connecting surfaces 31, 32 and a locating hole being disposed in the other one of the connecting surfaces 31, 32 for fitting with each other. While it is in operation, the thigh part is detached from the hip part first for the pants being put on and then the locating stem of the joining device 34 is inserted back into the locating hole for the connecting surfaces 31, 32 being joined to each other. However, it is a fact that the joining device 34 is incapable of obtaining a firm joint between the connecting surfaces 31, 32 with the locating stem and the locating hole. Besides, a clearance 34 often creates between the connecting surfaces 31, 32 after a period of time using and the clearance 34 worsens the undesirable connection of the thigh part to the hip part. Hence, the thigh part 32 becomes unstably disposed and it results in the artificial model with an unbalanced center of gravity. Under this circumstance, it is easy for the artificial model falling down or exhibited clothes being askew. Furthermore, once the joining device 33 is out of order, it is hard to be fixed unless the whole set of the artificial model is delivered to the repair shop. But, it is extremely inconvenient and less economical.

Referring to FIGS. 11A, 11B and 12, a conventional pin 442 and a locating disk 42 are illustrated. It can be seen that the locating disk 42 has a hollow center 422 for being inserted with the insert head 441. Two opposite elongated grooves 423 and two opposite recess 424 are disposed surrounding the hollow center 422 being perpendicular to the recesses. The pin 442 passes through the hollow center 423 and is rotated 90° to engage with the recesses 424. The preceding arrangement with regard to the pin 442 and the locating disk 42 is mostly used at the thigh separation part 35 of the artificial model as shown in FIG. 12 and it has the following disadvantages:

1. The position of the thigh separation part 35 is improperly disposed and it is unpleasing to the eye while shorts or swimming suit is put on because of the exposed thigh separation.

2. Only a pair of elongated grooves 423 is provided and it is hard to locate the pin 442 properly due to a long rotational path being turned.

3. It is easy for the pin 442 and the locating disk 42 being out of order because the pin 442 is rotated all the time and it is severely worn out due to friction between the pin 442 and the locating disk 42.

4. It is possible for the pin to roll into the hollow center in one direction only and it is easy for the thigh part 36 being inversely mounted carelessly as shown in FIG. 11.

5. In case of the artificial model 30 being in a state of a posture of sitting with two thighs being cross to each other as shown in FIG. 13, the pin 442 is incapable of being turned into the recesses 424 if the locating disk 42 is disposed at an improper angular position and it leads to the thigh 37 being unable to rotate in place.

In addition, a further conventional locating disk, which is similar to the locating disk 42, only has the elongated grooves 423 without the recesses 424 and it is incapable of performing the job of locating.

SUMMARY OF THE INVENTION

A main object of the present invention is to provide a coupling device for an artificial model in which connecting surfaces are joined tightly after two half parts of the coupling device being engaged to each other.

Another object of the present invention is to provide a coupling device for an artificial model in which the male and female connecting members and locating threaded holes are fabricated with standardized sizes so that both legs of the artificial model are interchangeable and different artificial models are interchangeable too for enhancing economical purpose.

A further object of the present invention is to provide a coupling device for an artificial model in which parts thereof are fastened with bolts so that it is convenient for replacing damaged parts quickly without the need of being fixed in shop.

A further object of the present invention is to provide a coupling device for an artificial model in which two sets of elastic bodies allow the male connecting member, the female connecting member and the pin to form an anti-compressed space during rotating such that the coupling device with low wear, little resistance and least possibility of damage can be obtained in addition to being easily operated and assembled.

BRIEF DESCRIPTION OF THE DRAWINGS

The other objects and features of the present invention can be more fully understood by reference to the following description of preferred embodiments in company with the drawing, in which.

DETAILED DESCRIPTION OF THE INVENTION

Figure 1:
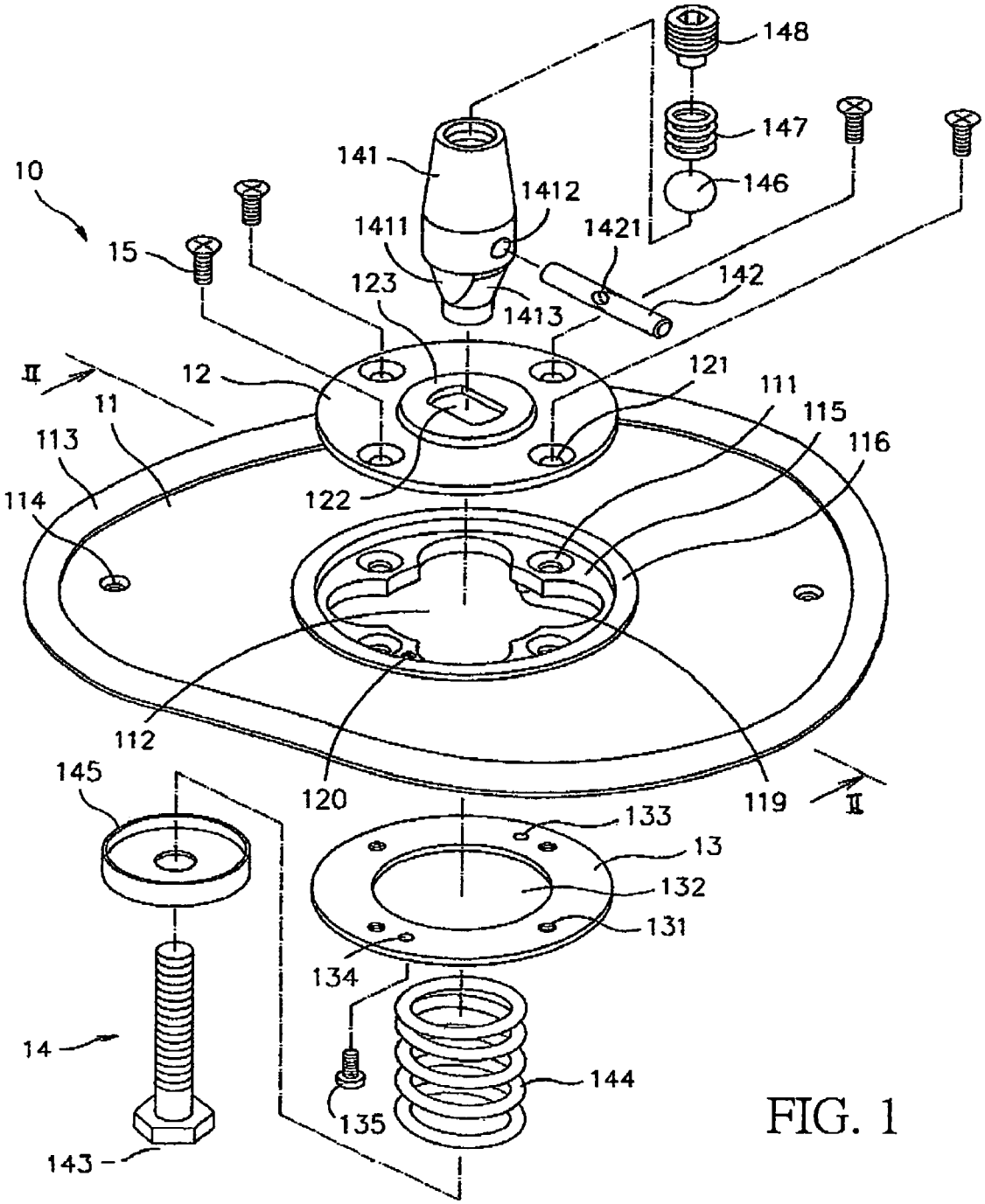
FIG. 1 is an exploded perspective view of a male joining part of a coupling device for an artificial model according to the present invention.
Figure 2:
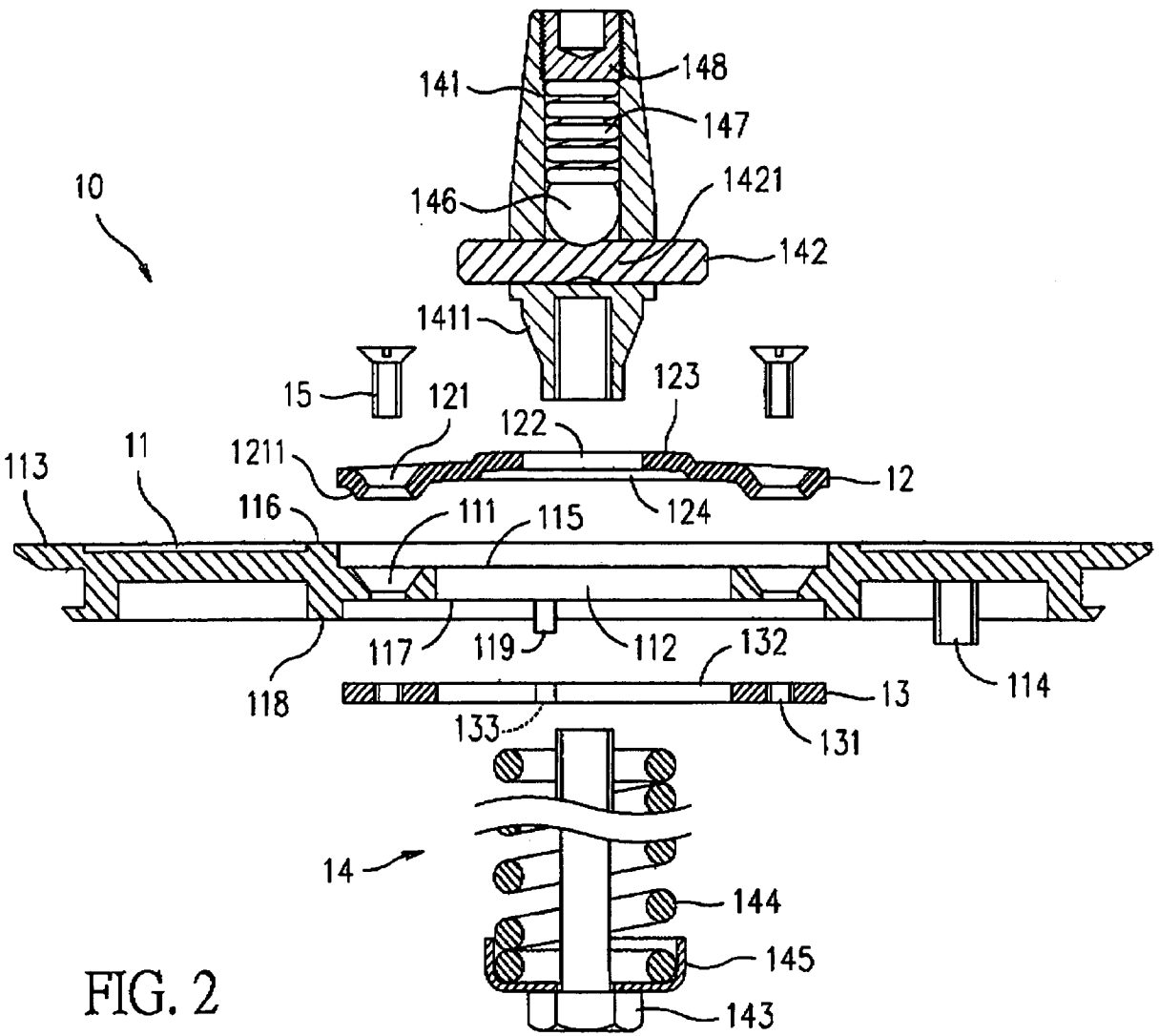
FIG. 2 is an exploded sectional view of the male joining part shown in FIG. 1.
Figure 3:
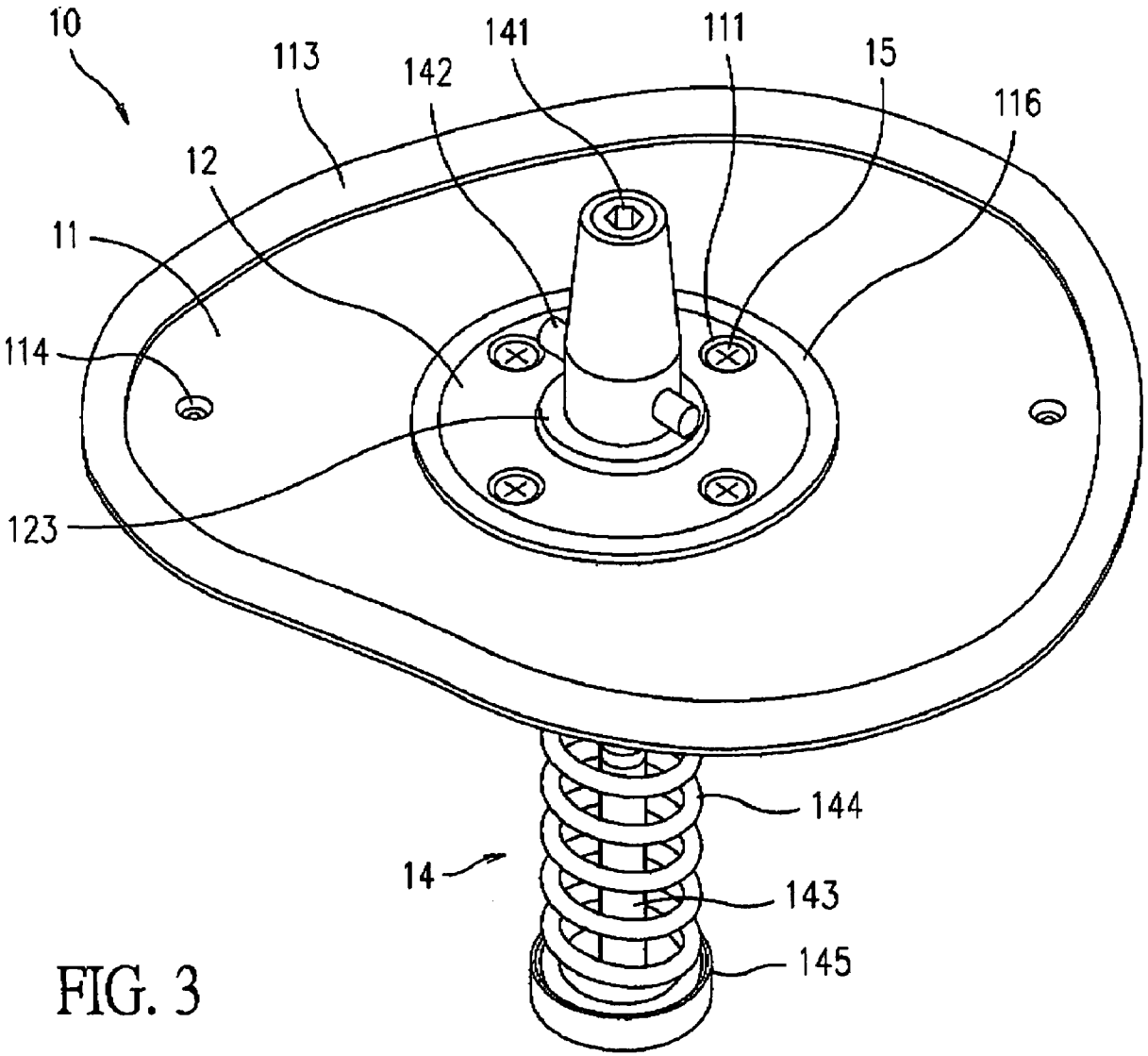
FIG. 3 is an assembled perspective view of the male joining part shown in FIG. 1.

Referring to FIGS. 1 to 3, a coupling device for an artificial model according to the present invention provides a male joint part 10, which includes a first base disk 11, a first front positioning plate 12, a first rear positioning lock plate 13 and an insertion member 14.

The first base disk 11 is provided with an upright rim 113 at the periphery thereof and a hollow center 112. Two threaded through holes 114 are disposed near the upright rim 113 and opposite to each other with respect to the axis of the hollow center 112. The threaded through holes 114 extend downward through two cylindrical posts attached to the lower facial side of the first base disk 11 to be located at one of the connecting surfaces of the hip part and hole thigh part. The first base disk 11 has a recess 115, 117 at the two facial sides thereof respectively and the recesses 115, 117 have a flange 116, 118 at the circumferences thereof respectively. A first partition between the recesses 115, 117 surrounds the hollow center 113 and is provided with four through holes 111 with a countersink top respectively.

The first front positioning plate 12 is circular and disposed in the recess 115 of the first base disk 11 with a central protrusion part 123 such that the bottom of the central protrusion part 123 is formed a recessing 124. The protrusion part 123 further has an elongated hollow center 122. In addition, the first front positioning plate 12 is provided with fourth through holes 121 with each of the through holes 121 being formed with two opposite countersinks respectively. The through holes 121 correspond to the threaded holes 111 and are surrounded with a conical lower end 1211 extending outward from the bottom thereof.

The first rear positioning lock plate 13 is provided with an annular shape and disposed in the recess 117 of the first base disk 11 with four threaded holes 131 corresponding to the threaded holes 111 too. Further, the first rear positioning lock plate 13 has an aperture 133 and a further threaded hole 134 corresponding to a post 119 extending downward from the bottom of the partition and a further threaded hole 120 disposed at the partition for locating the first rear positioning lock plate 13. It can be seen in the figures that the post 119 pierces the aperture 133 and a bolt 135 is utilized to engage with the threaded holes 134, 120 respectively so as to secure the first rear positioning lock plate 13 to the partition in the recess 117 as a protect for the first base disk 11. It is noted that the post 119 and the threaded hole 120 can be disposed at any places at the partition as long as the first rear positioning lock plate 13 is capable of being fixedly attached to the first bask disk 11.

The insertion member 14 is composed of an insert head 141, a pin 142, an adjustable bolt 143, an elastic body 144 and a cap 145 for the elastic body 144. The insert head 141 is hollow with two conical end parts and internal screw threads respectively. A ball 146 and an elastic body 147 such as a spring or a spring plate are placed therein from the upper end and fastened with a setscrew 148. The insertion head 141 is provided with a flat part 1411 at the lower conical end part thereof corresponding to the elongated hollow center 122 so as to loosely fit with the elongated hollow center 122. The middle part of the insert head 141 has a transverse fitting hole 1412 for being inserted through with the pin 142. The pin 142 has a recess part 1421 at the middle section thereof and is inserted into the fitting hole 1412, which is perpendicular to the axial direction of the insert head 141 crosses the axis of the insert head 141 such that the ball 146 can be located at the recess part 1421 against the elastic force of the elastic body 147 to constitute a tight fit between the ball 146 and the elastic body 147. Hence, the insertion member 14 is formed as a resilient positioning device at the upper and the lower parts thereof.

As the foregoing, the first front positioning plate 12 and the first rear positioning lock plate 13 are secured to the first base disk 11 with bolts 15 engaging with the threaded holes 131 via the through holes 111, 121 after the first front positioning plate 12 being placed in the recess 115 and the first rear positioning lock plate 13 being placed in the recess 117. Because the four through holes 121 are equally spaced from each other, the first front positioning plate 12 and the first rear positioning lock plate 13 have two orthogonal adjustable directions respectively for different postures of the artificial model at the legs thereof. Next, the insert head 141 is arranged to pass through the elongated hollow center 122 from the top of the first base disk 11 via the flat part 1411 to constitute a state of being immobilized. Then, the adjustable bolt 143 passes through the cap 145 and the elastic body 144 sequentially and engages with the lower end of the insert head 141 under the first base disk 11 against the elastic body 144 with an end of the elastic body 144 pressing the recessing 124 at the lower side of the first front positioning plate 12. In this way, the male joining part 10 can be set up completely. Due to the threaded holes 111 and the through holes 121 being provided with countersinks, a flexible adjusted space is available between the first front positioning plate 12 and the first base disk 11 to allow the bolts 15 being capable of fastening the first front positioning plate 12 and the first base disk 11 firmly. Further, the recessing 124 provides a function for locating the elastic body 144 to prevent the elastic body 144 from slip and the central protrusion part 123 on the first front positioning plate 12 avoids the insert head 141 moving away for enhancing effect of locating the elastic body 144. Once the adjustable bolt 143 engages with the insert head 141, a bias force resulting from the elastic body 144 created between the recessing 124 and the cap 145 can pull down the insert head 141. The function of the force will be explained in detail underneath.

Figure 4:
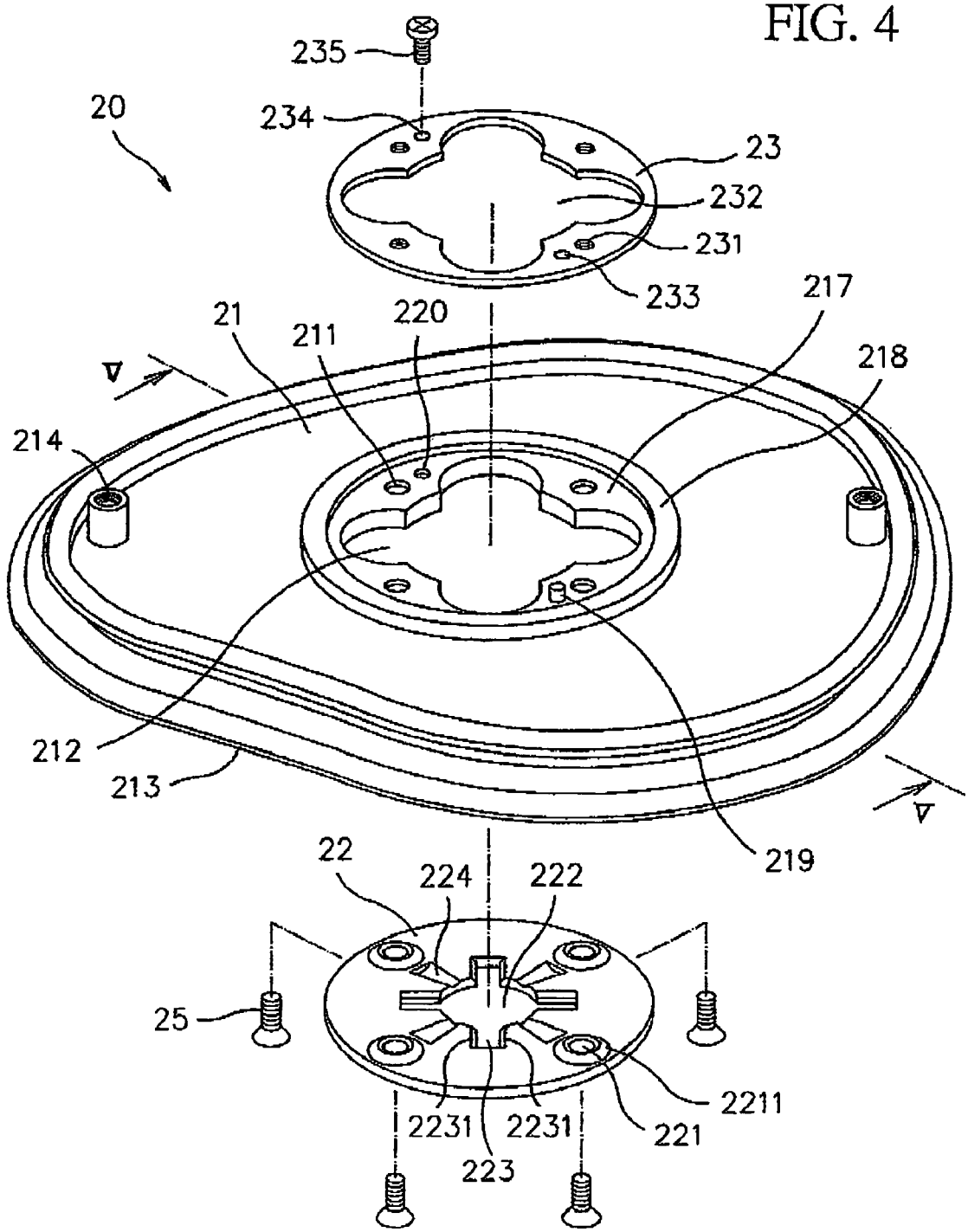
FIG. 4 is an exploded perspective view of a female joining part of the coupling device for an artificial model according to the present invention.
Figure 5:
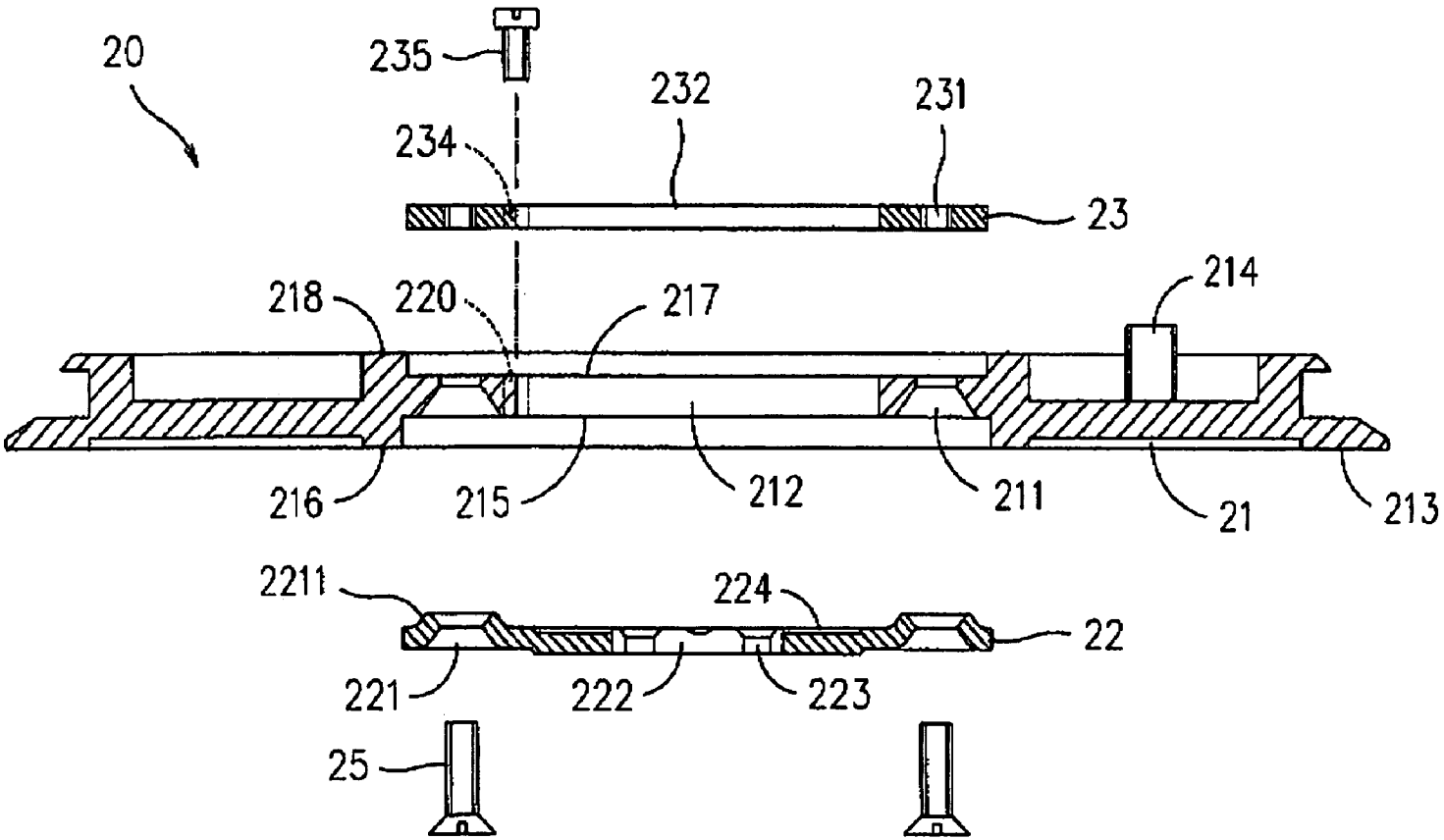
FIG. 5 is an exploded sectional view of the female joining part shown in FIG. 4.
Figure 6:
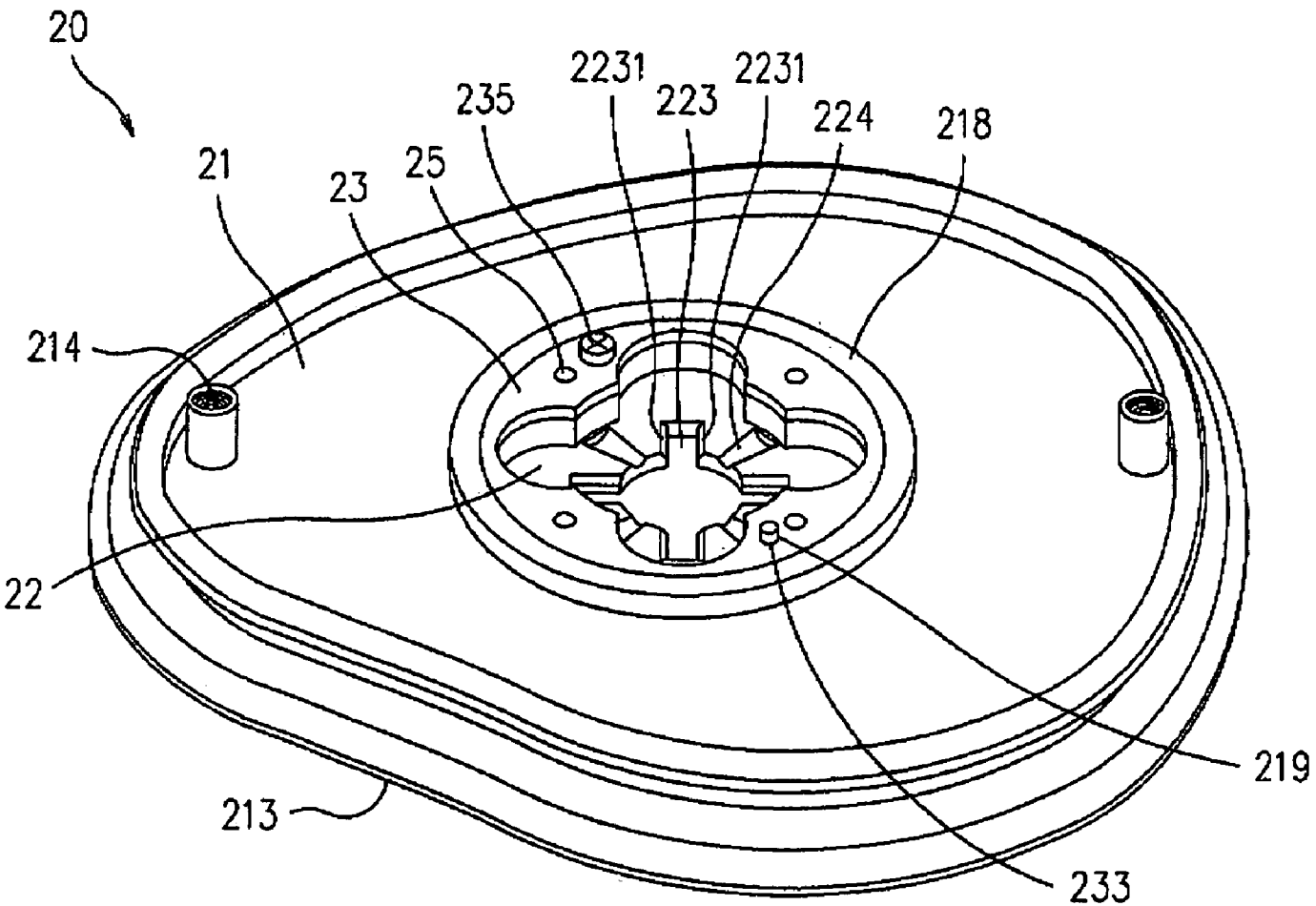
FIG. 6 is an assembled perspective view of the female joining part shown in FIG. 4.

Referring to FIGS. 4 to 6, the coupling device for an artificial model according to the present invention further provides a female joining part 20, which includes a second base disk 21, a second front positioning plate 22 and a second rear positioning lock plate 23.

The second base disk 21 is provided with an upright rim 213 at the periphery thereof and a hollow center 212. Two threaded holes 214 are opposite to each other with respect to the axis of the second hollow center 212 and disposed near the upright rim 213. The two threaded holes 214 extend upward through two cylindrical posts attached to the upper facial side of the second base disk 21 for locating the second base disk 21 at another one of the connecting surfaces on the hip part and the thigh part. The second base disk 21 has a recess 215, 217 respectively at the two facial sides thereof and the recesses 215, 217 have a flange 216, 218 respectively at the circumferences thereof. A second partition between the recesses 215, 217 surrounds the second hollow center and is provided with four through holes 211 with a countersink bottom respectively.

The second front positioning plate 22 is disposed in the recess 215 of the second base disk 11 with a hollow center 222 for being inserted with the insert head 141. A plurality of radial grooves 223 extend from the periphery of the hollow center 222 equidistantly and two opposite ones of the radial grooves 223 constitute a space available for being passed through with the pin 142 of the insertion member 14. An elongated recess 224 is provided between every two neighboring radial grooves. In addition, the second front positioning plate 22 is provided with through holes 221 corresponding to the threaded holes 211 of the second base disk 21 and each of the threaded holes 221 is composed of two opposite countersinks and surrounded with a conical end 2211 extending outward from the top thereof.

The second rear positioning lock plate 23 is disposed in the recess 217 of the second base disk 21 with a hollow space 232 and four threaded holes 231 corresponding to the through holes 211 of the second base disk 21 too. Further, the second rear positioning lock plate 23 has an aperture 233 and a through hole 234 corresponding to a post 219 and a threaded hole 220 disposed at the second partition for locating the second rear positioning lock plate 13. Due to the post 219 piercing the aperture 233 and a bolt 235 being utilized to engage with the threaded hole 220 via the hole, the second rear positioning lock plate 13 can be located in the recess 117 and secured to the second base disk 21. It is noted that the post 219 and the threaded hole 220 are disposed at any places under a condition of the second rear positioning lock plate 23 being corresponding to the second base disk 21.

Thus, as the second front positioning plate 22 is placed in the recess 215 and the second rear positioning lock plate 23 is placed in the recess 217, the second front positioning plate 22 and the second rear positioning lock plate 23 can be secured to the second base disk 21 by way of bolts 25 passing through and being fastened to the threaded holes 231 via the through holes 221, 211. Because the fourth through holes 221 are equally spaced from each other, the second front positioning plate 22 and the second rear positioning lock plate 23 have two orthogonal adjustable directions respectively for different postures of the artificial model at the legs thereof. In this way, the female joining part 20 can be set up completely. Due to the through holes 211, 221 being provided with countersinks respectively, a flexible adjusted space is available between the second front positioning plate 22 and the second base disk 21 to allow the bolts 25 being capable of fastening the second front positioning plate 22 and the second base disk 21 firmly.

Figure 7A:
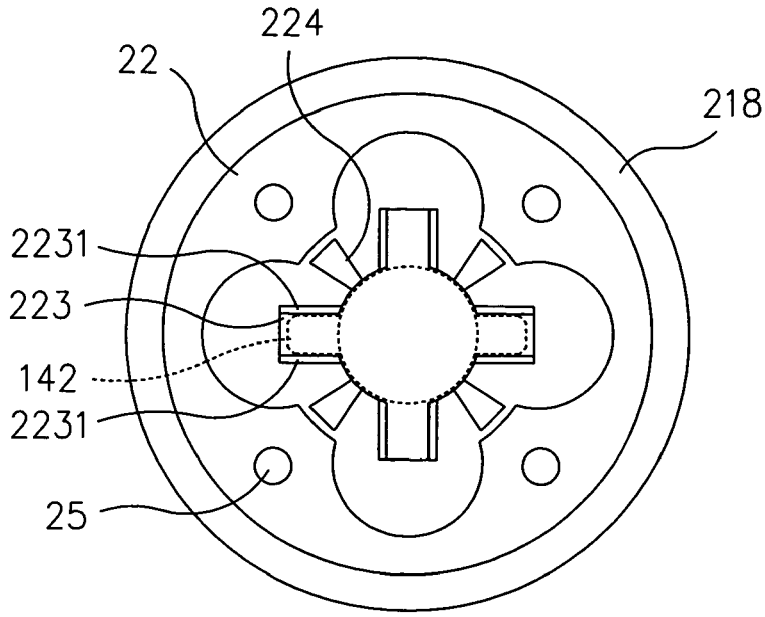
FIGS. 7A and 7B are plan views illustrating movements of positioning done by an insertion member in the coupling device of the present invention.
Figure 7B:
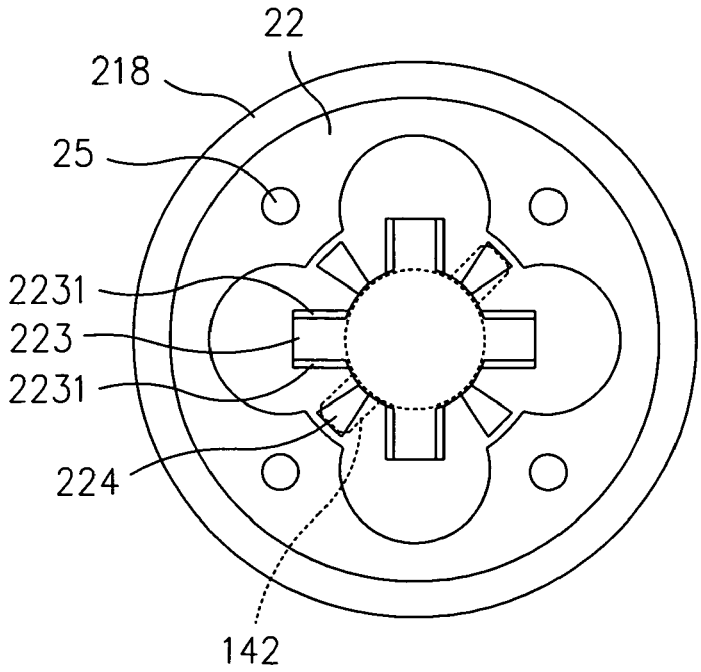
Figure 8:
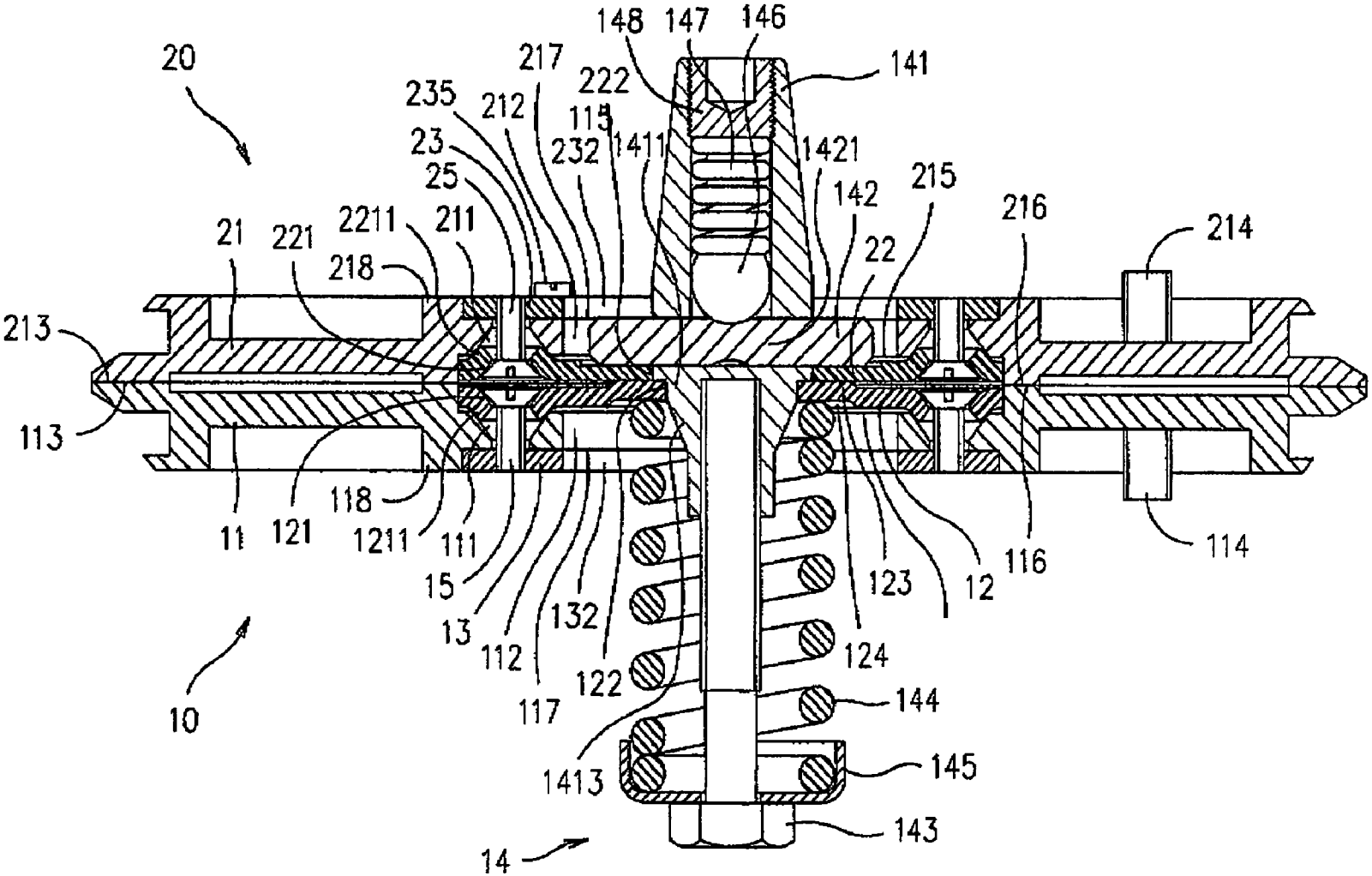
FIG. 8 is a sectional view of the coupling device for an artificial model according to the present invention.

Referring to FIGS. 7A, 7B, and 8, the insert head 141 is inserted into the hollow center 222 of the second front positioning plate 22 with the pin 142 passing through two opposite radial grooves 223 to allow the two base disks 11, 21 being attached with the two front positioning plates 12, 22 respectively. Then, the male joining part 10 is turned to allow the pin 142 rotating to the recess 224 at the lower side of the second front positioning plate 22. Because the radial grooves 223 have a chamfer at the inner rims thereof respectively to facilitate the pin 142 turning into the recess 224. Due to the first front positioning plate 12 with the central protrusion part 123 thereof and the elastic force of the elastic body 144 in the insertion member 14, a downward pull force is generated to exert the insert head 141 and the pin 142 to locate the pin 142 in the recess 224. In this way, the male joining part 10 and the female joining part 20 are capable of being joined to each other tightly. Further, the radial grooves 223 and the recess 224 not only can offer different rotational directions to meet the requirement for different postures of the artificial model but also a distance between neighboring radial grooves 223 and the recess 224 is short so that the rotational path is reduced considerably. Hence, it can be rotated easily with less labor hours and it is capable of avoiding the first front positioning plate 12 or the pin 142 being worn out with high damage rate. When the pin 142 is located as shown in FIG. 8, tightness of locating the pin 142 can be micro-adjusted with the adjustable bolt 142 and the male joining part 10 and the female joining part 20 can be joined together in an optimum state by way of the elastic body 144 pressing against the cap 145.

It is noted that both the base disks 11, 21 have an appearance almost reflecting to each other so that the upright rims 113, 213 result in a clearance being formed between the first and second base disks 11, 21 to contact between the first and second base disks 11, 21 more smoothly. Further, due to the male joining part 10 at the center thereof having the flange 116 corresponding to the flange 216 at the center of the female joining part 20, it is able to prevent the connecting surfaces at the hip separation part of the artificial model from being worn out caused by frictional contacts.

Referring to FIG. 8 again, after the first and second base disks 11, 21 being exactly joined to each other, the flat part 1411 can be secured to the elongated hollow center 122 due to the conical part 1413 being disposed next to the flat part 1411 at the lower end of the insert head 141. This is a feature not provided in the traditional artificial model. The function of the conical part 1413 will be described in detail hereinafter.

Figure 9A:
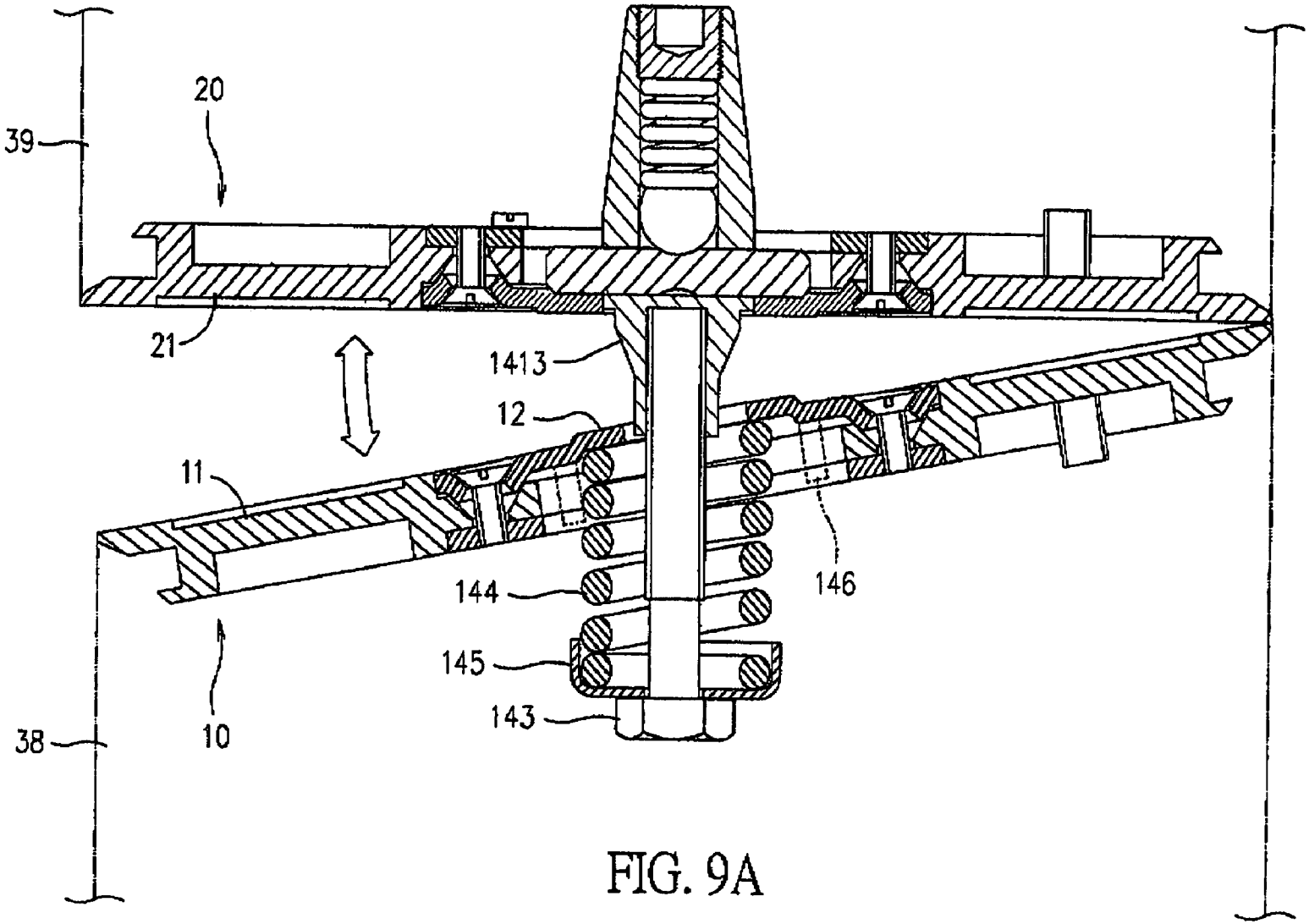
FIG. 9A is a sectional view illustrating the coupling device being embodied in the artificial model with the left side thereof being in a state of opening.
Figure 9B:
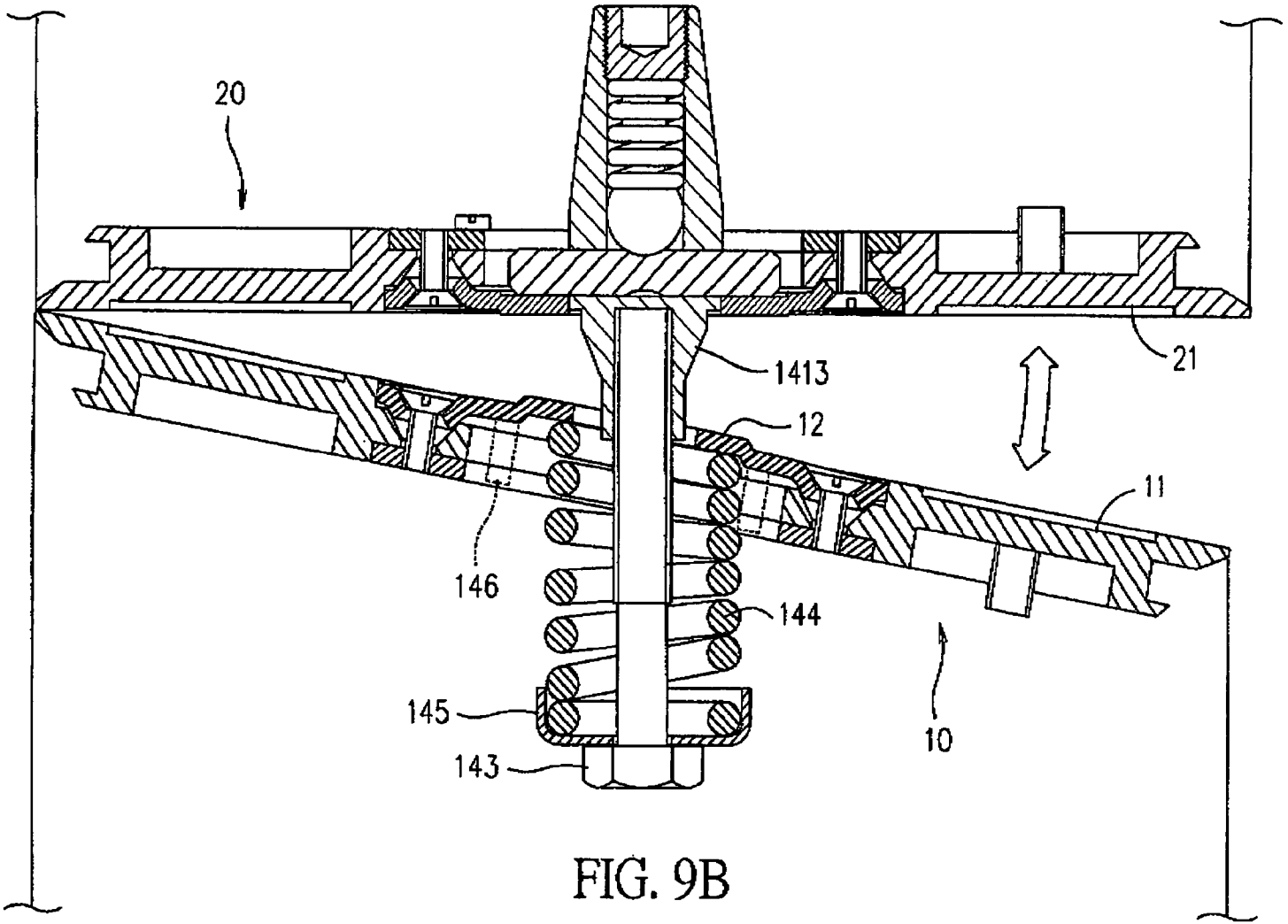
FIG. 9B is a sectional view illustrating the coupling device being embodied in the artificial model with the right side thereof being in a state of opening.
Figure 10:
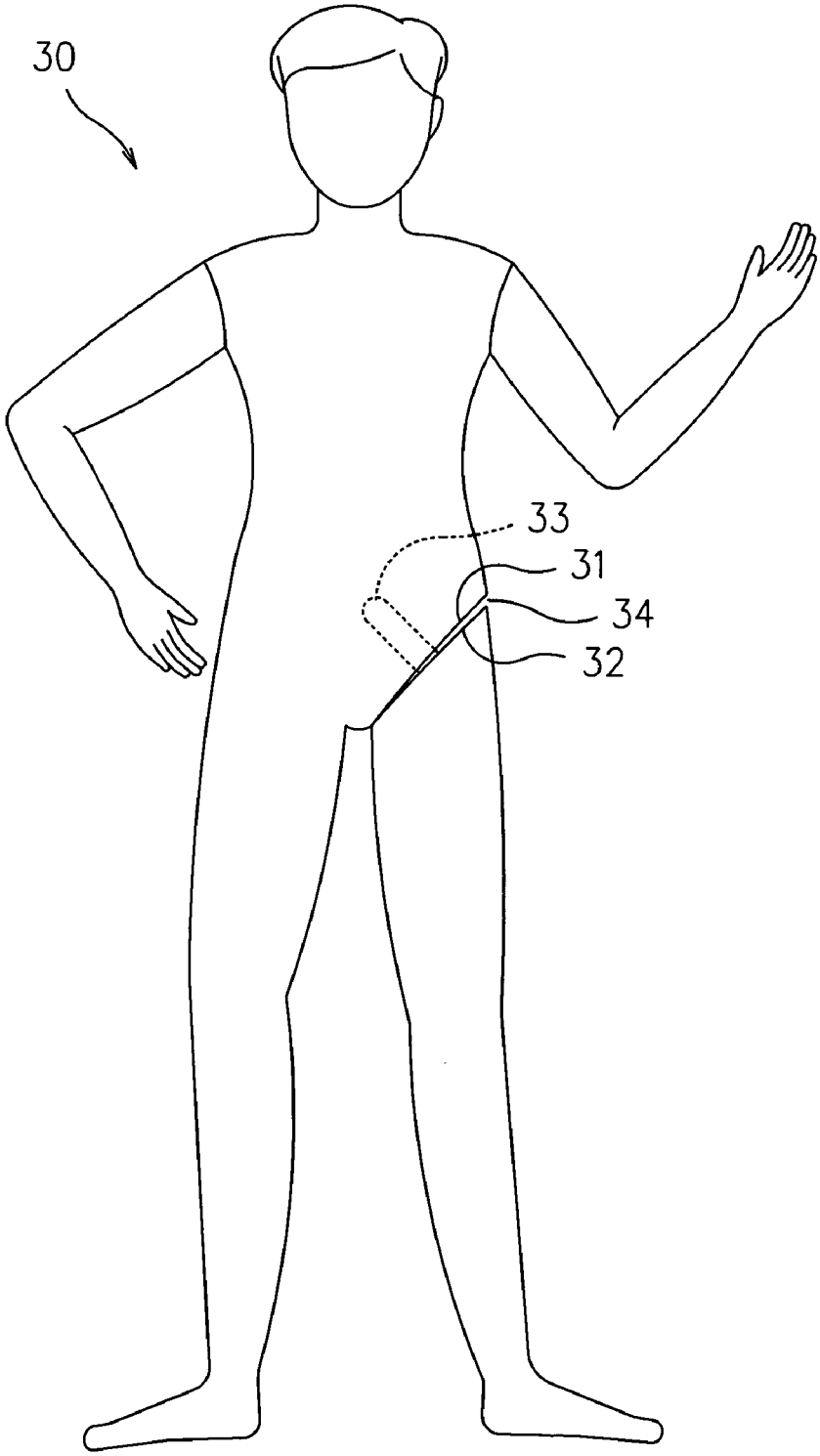
FIG. 10 (PRIOR ART)
FIG. 10 is a plan view illustrating a conventional hip joint of the artificial model.
Figure 11A:
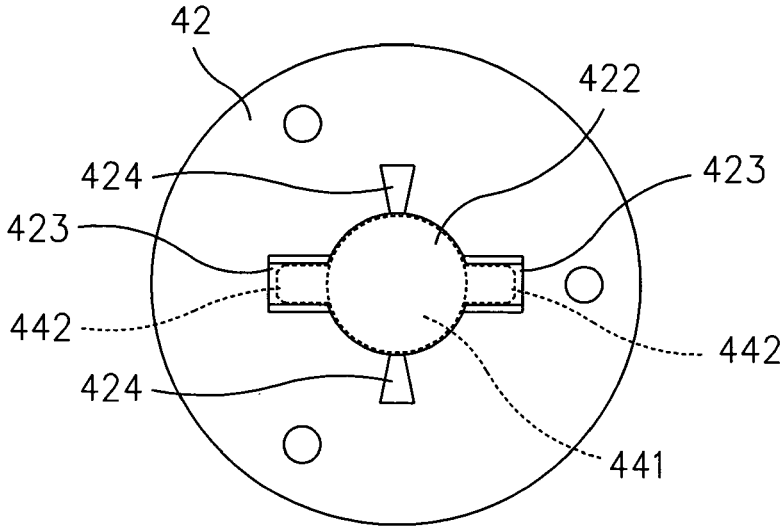
FIG. 11A (PRIOR ART)
FIGS. 11A and 11B are plan views illustrating movements of positioning done by a conventional pin.
Figure 11B:
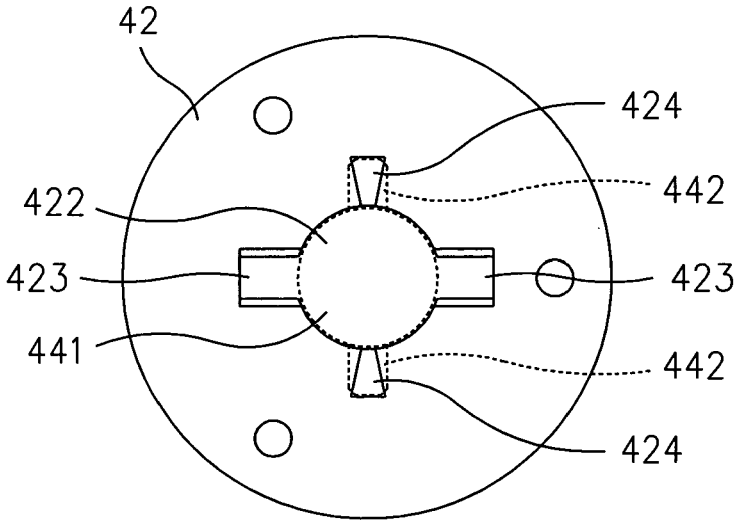
FIG. 11B (PRIOR ART)
Figure 13:
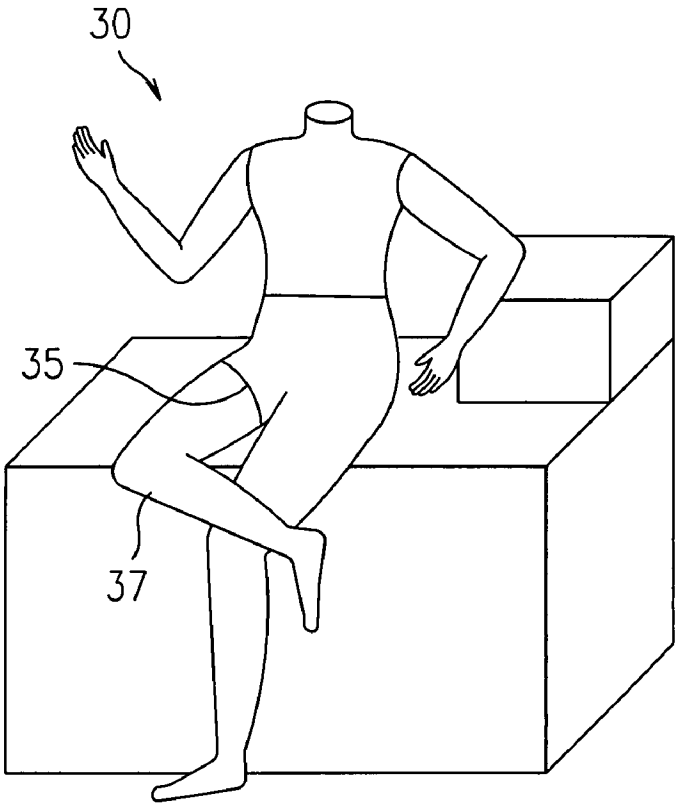
FIG.13 (PRIOR ART)
FIG. 13 is a plan view illustrating the seat posture of the artificial model.
Figure 12:
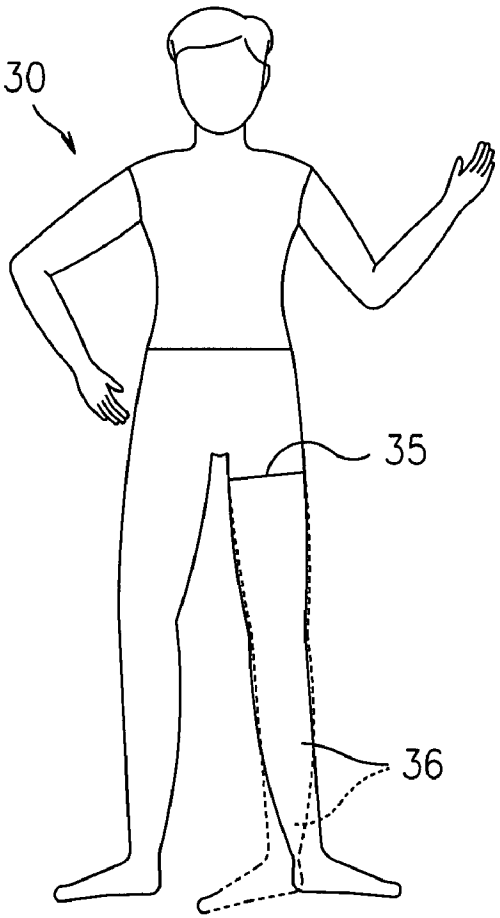
FIG. 12 (PRIOR ART)
FIG. 12 is a plan view illustrating another conventional hip joint of the artificial model.

Referring to FIGS. 9A and 9B, the male joining part 10 is attached to the upper side of a thigh part 38 of the artificial model and the female joining part 20 is attached to the hip part 39 of the artificial model corresponding to the male joining part 10. The characteristic of the present invention is in that once the thigh part 38 is pushed by a foreign force to actuate the first base disk 11 separating from the second base disk 21, the first base disk 11 can comply with the taper of the conical part 1413 and restore to the original position due to the elastic force of the elastic body 144. The elastic body 144 surrounds the adjustable bolt 143 and is disposed between the first front positioning plate 12 and the cap 145 such that the elastic body 144 extends to press the first front positioning plate 12 and the cap 145 tightly without offsetting. Hence, it is not necessary to detach the thigh part 38 from the hip part 39 before a pair of trousers being put on to or taken off from the artificial model and the only thing has to be done is to open the thigh part 38 an appropriate angle as shown in FIGS. 9A and 9B. It is noted that FIGS. 9A and 9B illustrating the thigh part 38 being opened at the right side or at the left side is only an example for explaining how the coupling device of the present invention works. Actually, the thigh part 38 can be opened 360 degrees, that is, the thigh part 38 can be turned around with respect to a contact point of the base disks 11, 21, so that time spend for setting up the thigh part 38 can be saved and damage rate can be reduced dramatically. Further, the male joining part 10 and the female joinng part 20 can be interchanged the positions thereof in practice. Hence, positions of the joining parts 10, 20 at two thigh parts 38 can be differently arranged as desired.

In addition, referring to FIGS. 1 to 3 again, the insert head 141 of the insertion member 14 is hollow with internal screw threads at both ends thereof and the ball 146 with the elastic body 147 is placed in the hollow space such that a setscrew 148 engages with the internal screws at the upper end and the adjustable bolt 145 engages with the internal screws at lower end to constitute a state of locating the insertion member 14 being performed with both elastic bodies 144, 147.

Moreover, the pin 142 at the middle section of the insert head 141 has a recess ring 1421 for the setscrew 148 being micro-adjusted to press the ball 146 against the recess ring 1421 so that the first front positioning plate 12 can be micro-adjusted upward or downward with the adjustable bolt 143 to obtain a precise engagement.

While the invention has been described with reference to preferred embodiments thereof, it is to be understood that modifications or variations may be easily made without departing from the spirit of this invention, which is defined by the appended claims.

What is claimed is:

1. A coupling device for an artificial model, comprising a male joining part; and a female joining part, being joined to the male joining part tightly; wherein, the male joining part further comprises:

a first base disk with a first hollow center;

a first front positioning plate with a second hollow center, having a central circular protrusion part;

a rear positioning lock plate with a third hollow center;

a plurality of first bolts, fastening the base disk, the front positioning plate and the rear positioning lock plate together; and an insertion member, passing through the base disk, the front positioning plate, the rear positioning lock plate via the hollow centers;

and the female joining part further comprises;

a second base disk;

a second front positioning plate;

a second rear positioning lock plate; and a plurality of second bolts, fastening the second base disk, the second front positioning plate and the second rear positioning lock plate tighter;

characterized in that the insertion member is composed of an insert head, a pin, an adjustment bolt, a first elastic body and a covering cap with the insert head having a conical shape and an elongated flat part at a bottom thereof; the pin is inserted into the insert head along a radial direction of the insert head and passing through an axis of the insert head to form a shape of cross; the second hollow center has a shape corresponding to the elongated flat part of the insert head such that the elongated flat part of the insert head can fit with the second hollow center after being inserted into the second hollow center with the adjustment bolt passing through the cap and the first elastic body before engaging with the bottom of the insert head; the second front positioning plate at a center thereof has a hollow part with a plurality of equidistant radial grooves and two opposite ones of the radial grooves are pierced with the pin; and a radial recess is disposed between two neighboring ones of the radial grooves respectively;

whereby, the male joining member and the female joining member can be joined to each other tightly and be inserted into each other for achieving a purpose of positioning.

2. The coupling device for an artificial model according to claim 1, wherein the insert head has a hollow part with internal screw threads and a fitting hole and another elastic body with a ball is disposed in the hollow part such that the insert head can be engaged to a screw rod and the pin has a recess and is inserted into the fitting hole with the ball being located in the recess to form a structure of at an lower section of the insert head having a second elastic body.

3. The coupling device for an artificial model according to claim 1, wherein each of the radial grooves of the second front positioning plate at an inner edge thereof has a guide chamfer.

4. The coupling device for an artificial model according to claim 1, insert head at a lower end of the elongated flat part thereof has a conical part disposed in the elastic body and the elastic body surrounds the adjustment bolt and is disposed between the first positioning plate and the cap in a state of biasing against the first positioning plate and the cap; whereby, after the first base disk being subjected to a foreign force to separate the female joining part, the first base disk can be pushed back to original position thereof along a taper of the conical part quickly because of an elastic force of the elastic body.

5. The coupling device for an artificial model according to claim 4, wherein the first positioning plate is provided with a plurality of posts to confine the elastic body and prevent the elastic body from slip.

6. The coupling device for an artificial model according to claim 1, wherein the first base disk and the second base disk at peripheries thereof have a respective upright rim facing to each other such that a clearance between the two base disks can be formed with more smooth contact.

7. The coupling device for an artificial model according to claim 1, wherein the first base disk and the second base disk at a side thereof have a recess respectively to receive the first front positioning plate and the second front positioning plate with each of the recesses having a flange to avoid hips of the artificial model at peripheries thereof being damaged due to frictional contact.

8. The coupling device for an artificial model according to claim 1, wherein the first and the second base disks have threaded holes with respect to the centers of the two base disks respectively for the base disks being attached to the hips of the artificial model.

9. The coupling device for an artificial model according to claim 8, wherein the threaded holes of the first and the second base disks are disposed equidistantly to allow the first and the second front positioning plates or the first and the second rear positioning lock plates being able to be arranged to have two adjusted cross orientations.

10. The coupling device for an artificial model according to claim 1, wherein the first and the second positioning plates at a side thereof respectively facing the threaded holes of the first and the second base disks have a jut out cone respectively and the threaded holes have a countersink corresponding to the jut out cone.

11. The coupling device for an artificial model according to claim 1, wherein the first front positioning plate at the rear side thereof has a locating recess to prevent the first elastic body from slipping.

12. The coupling device for an artificial model according to claim 1, wherein the first rear positioning lock plate and the second rear positioning lock plate are provided with an aperture and a hole respectively corresponding to a post and a threaded hole at the first base disk and the second base disk respectively for locating the first and the second rear positioning lock plates by way of the posts being inserted into the apertures and a bolt engaging the threaded holes respectively.

13. The coupling device for an artificial model according to claim 12, wherein the first base disk and the second base disk are provided with a recess facing the first rear positioning lock plate and the second rear positioning lock plate respectively and the rear positioning lock plate are provided with a hollow part corresponding to the post respectively for locating the rear positioning lock plates quickly.

* * * * *